US006584913B2

(12) United States Patent
Cloud

(10) Patent No.: US 6,584,913 B2
(45) Date of Patent: Jul. 1, 2003

(54) PORTABLE ADJUSTABLE WORK STATION

(76) Inventor: William Cloud, 3100 Tee La., Knoxville, TN (US) 37918

( * ) Notice: Subject to any disclaimer, the term of this patent is extended or adjusted under 35 U.S.C. 154(b) by 0 days.

(21) Appl. No.: 09/766,033

(22) Filed: Jan. 19, 2001

(65) Prior Publication Data

US 2002/0096091 A1 Jul. 25, 2002

(51) Int. Cl.[7] ..... A47B 23/00
(52) U.S. Cl. ..... 108/43; 108/5
(58) Field of Search ..... 108/43, 49, 5, 108/6, 8, 10

(56) References Cited

U.S. PATENT DOCUMENTS

| | | | | | |
|---|---|---|---|---|---|
| 370,824 | A | | 10/1887 | Small | |
| 1,232,757 | A | * | 7/1917 | Berkey | 108/49 |
| 1,653,657 | A | * | 12/1927 | Pretsch | 108/43 X |
| 2,681,840 | A | * | 6/1954 | Miller | 108/49 |
| 3,698,328 | A | * | 10/1972 | Weir | 108/49 X |
| 4,108,083 | A | | 8/1978 | Espinosa | |
| 4,292,748 | A | * | 10/1981 | Miller | 108/43 X |
| 4,378,646 | A | | 4/1983 | Mazeika | |
| 5,129,702 | A | * | 7/1992 | Ervin | 108/49 X |
| 5,144,898 | A | * | 9/1992 | Posly | 108/49 X |
| 5,359,741 | A | * | 11/1994 | Lang | 108/49 X |
| 5,598,786 | A | * | 2/1997 | Patterson | 108/43 |
| 5,606,918 | A | * | 3/1997 | Cauffiel | 108/49 X |
| 5,720,465 | A | | 2/1998 | Peltzer et al. | |
| 5,971,344 | A | | 10/1999 | Ainsworth | |
| 6,027,092 | A | | 2/2000 | Gordon | |
| 6,044,758 | A | | 4/2000 | Drake | |

* cited by examiner

*Primary Examiner*—Jose V. Chen
(74) *Attorney, Agent, or Firm*—Pitts & Brittian, P.C.

(57) ABSTRACT

A portable adjustable work station including a base and a substantially planar work platform disposed vertically above the base with a support assembly extending between the base and proximate the work platform for support thereof. The support assembly includes structure for vertically adjusting the vertical spacing of the work platform above the base, and further includes an upper end. There is interposed between the upper end of the support assembly and the work platform structure for interconnecting the upper end of the support assembly to the work platform and defining an axis for rotation of the plane of the work platform in either direction from the horizontal between first and second limits. The work platform is further mounted for lateral translation thereof within its plane, irrespective of the attitude of the work platform with respect to the horizontal.

12 Claims, 7 Drawing Sheets

Fig.7
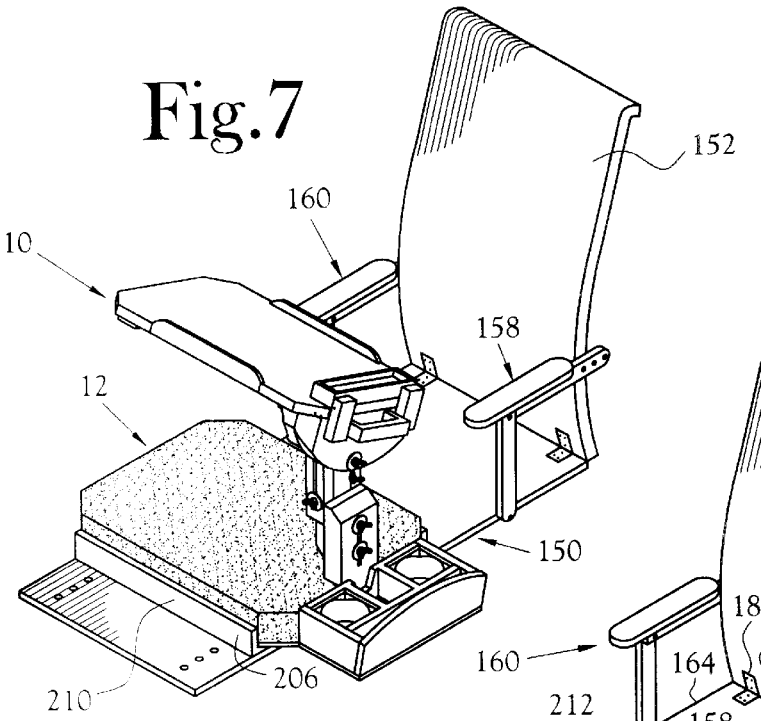
Fig.8
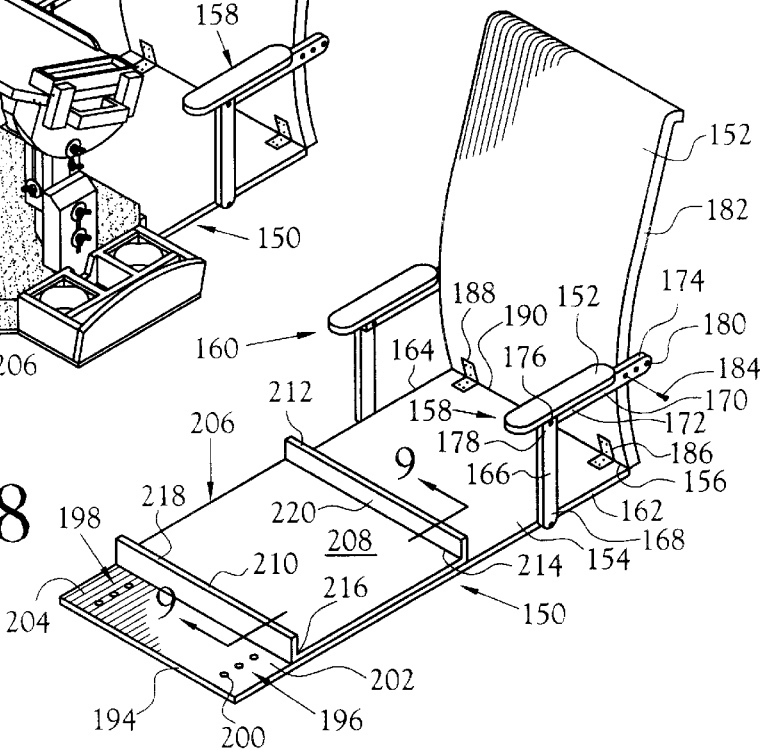
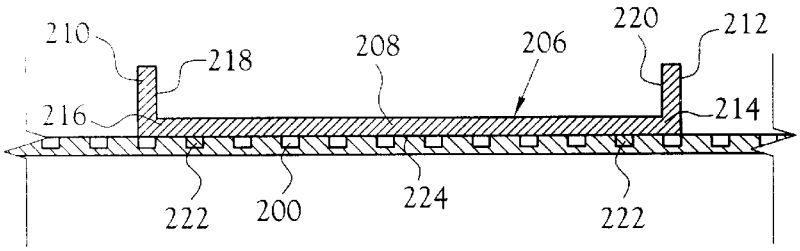
Fig.9

PORTABLE ADJUSTABLE WORK STATION

BACKGROUND OF INVENTION

This invention relates to portable work stations.

Prior portable work stations have included lap desks and upright reading stands designed to be adjustable in height to accommodate users in seated or inclined positions. These prior devices generally are designed to receive or have mounted thereon, some specific object, such as a book, a writing pad, a crochet holder, etc. These devices provide a limited number of positions for their work holder or working surface, partially by reason of the specificity of their function.

It is therefore an object of the present invention to provide a portable work station having a work platform that is adjustable to different vertical positions, rotatable about a substantially horizontal axis, and/or translatably laterally of its support irrespective of the attitude of the work platform with respect to the horizontal.

It is a further object of the present invention to provide a work station that includes a work platform that may be equally accessed from either of the opposite sides thereof.

SUMMARY OF INVENTION

In accordance with the present invention there is provided a portable adjustable work station including a substantially planar base and a substantially planar work platform disposed vertically above the base. A support assembly extends between the base and proximate the work platform and supports the work platform relative to the base. The support assembly includes means for vertically adjusting the vertical spacing of the work platform relative to the base. The support assembly further includes an upper end and means interposed between such upper end and the work platform for interconnecting the upper end of the support assembly with the work platform, and providing for rotational positioning of the work platform about an axis extending laterally of, and generally perpendicular to, the support assembly (i.e. horizontal), whereby the plane of the work platform is rotationally adjustable between first and second limits.

The work platform is displaceable laterally within its plane at any of the rotational positions of the work platform. All adjustments of the work platform relative to the support assembly and base are available to a user without repositioning of the work station base.

BRIEF DESCRIPTION OF THE FIGURES

FIG. 7 is a representation of an alternative embodiment of the present invention including a portable work station including a seperable mounting platform therefor;

FIG. 8 is a representation of the seperable mounting platform depicted in FIG. 7; and FIG. 9 is sectional view taken generally along the line 9—9 of FIG. 8.

DETAILED DESCRIPTION OF INVENTION

Figure 1:
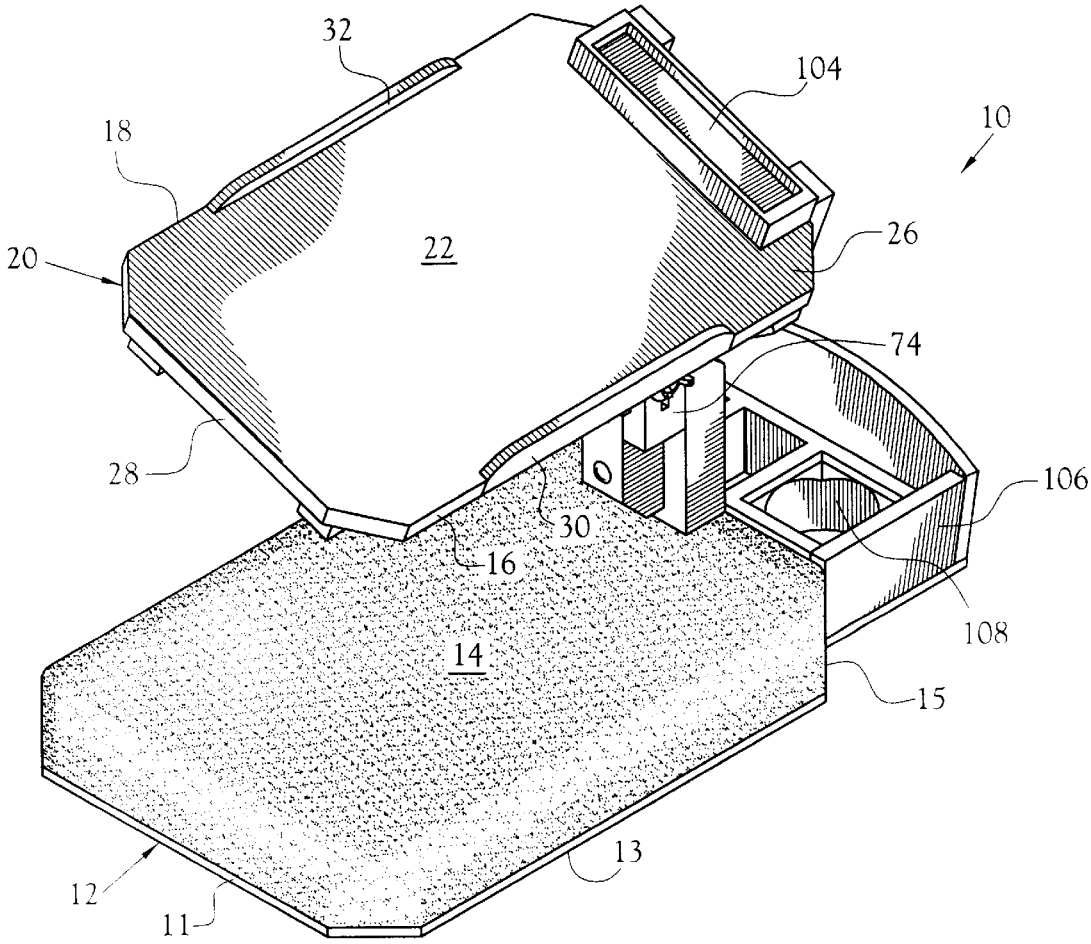
FIG. 1 is a perspective representation of one embodiment of a portable adjustable work station embodying various features of the present invention.

Referring initially to FIG. 1, one embodiment of a portable adjustable work station 10 in accordance with the present invention includes a generally planar base 12 and a substantially planar work platform 20 disposed vertically above the base 12. A support member assembly 34 extends between the base 12 and proximate the work platform 20, and includes means for vertically adjusting the vertical spacing of the work platform 20 relative to the work station base 12.

As noted, the base 12 is generally planar and includes a bottom surface 13 adopted for positioning of the work station 10 on a bed, on a table, or directly on a floor. An upper surface 14 of the base 12 preferably includes a padded, contoured surface 14 (e.g., a cushion). The depicted base includes first and second opposite ends 11,15 respectively, and first and second opposite sides 17,19, respectively. One embodiment of the base 12 includes an optional storage tray 106 attached on the second 15 end of the base 12, with the tray 106 including therein a plurality of storage sections 107, 109 (see FIG. 2) for writing utensils, etc., plus one or more cup holders 108.

Also as noted, the work platform 20 is substantially planar and includes substantially flat and parallel upper 22 and underside 24 surfaces (see FIGS. 1 and 3), and first and second opposite sides 16, 18 respectively and first and second opposite ends 26,28, respectively. Centrally positioned along the first side 16 and second side 18, are respective ledges 30, 32, raised above the planar upper surface 22 (see FIG. 1). Each ledge 30, 32 provides for retention of a work product such as reading material and/or writing material, on the upper surface 22 when the work platform 20 is rotationally positioned clockwise (see FIGS. 1 and 6*a*), or counterclockwise (see FIGS. 2 and 6*b*) about an axis 60 generally perpendicular to the support member assembly 34 (see FIG. 4).

In the depicted embodiment, the work platform 20 includes a first end 26 having an optional accessory tray 104 attached thereon for storage of writing utensils and miscellaneous items. In one embodiment, the planar upper surface 22 is substantially rectangular, having a length of about eighteen inches to about twenty-four inches from its first end 26 to its second end 28.

Figure 2:
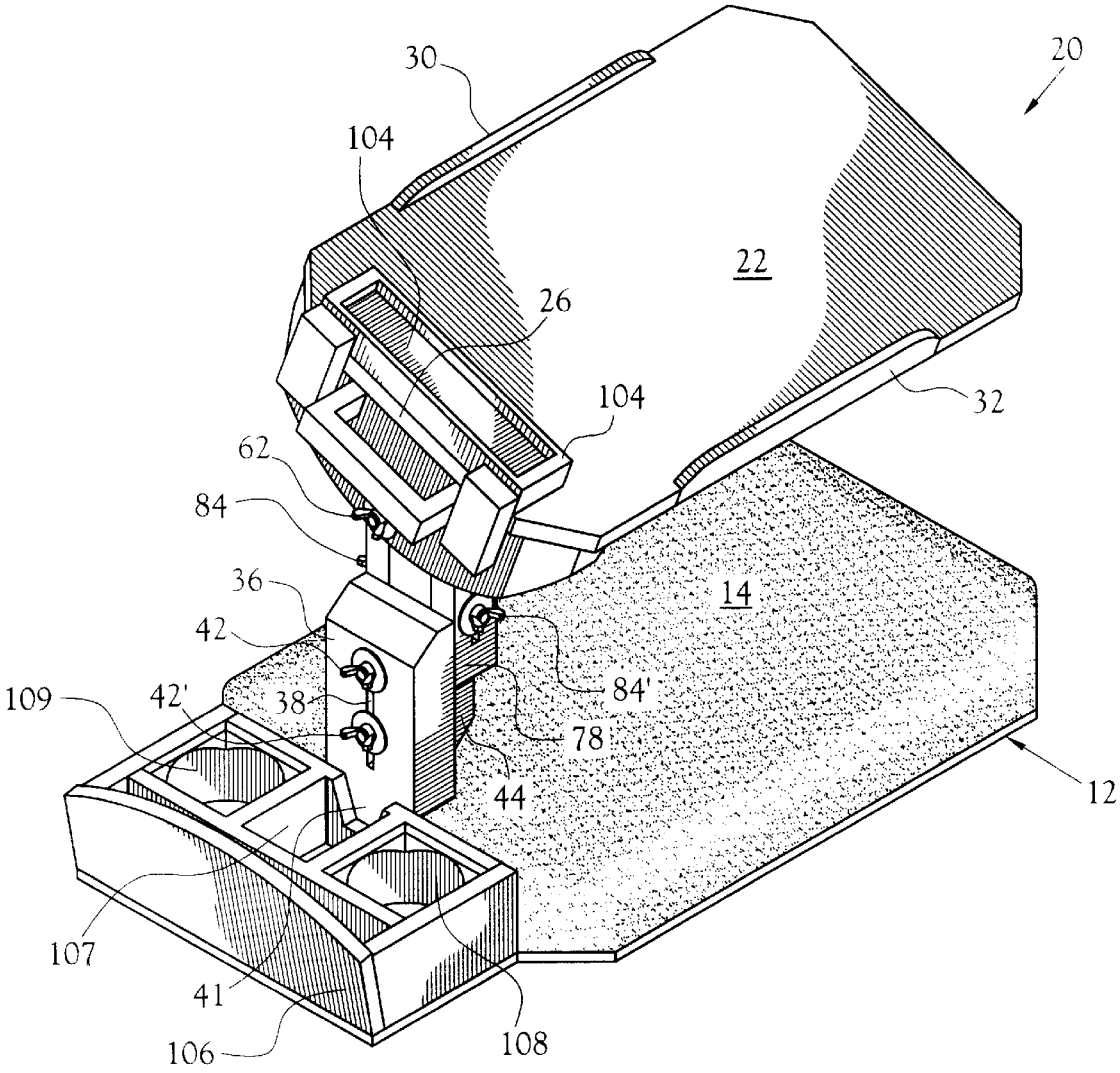
FIG. 2 is a perspective representation of a reverse view of the work station depicted in FIG. 1.
Figure 6B:
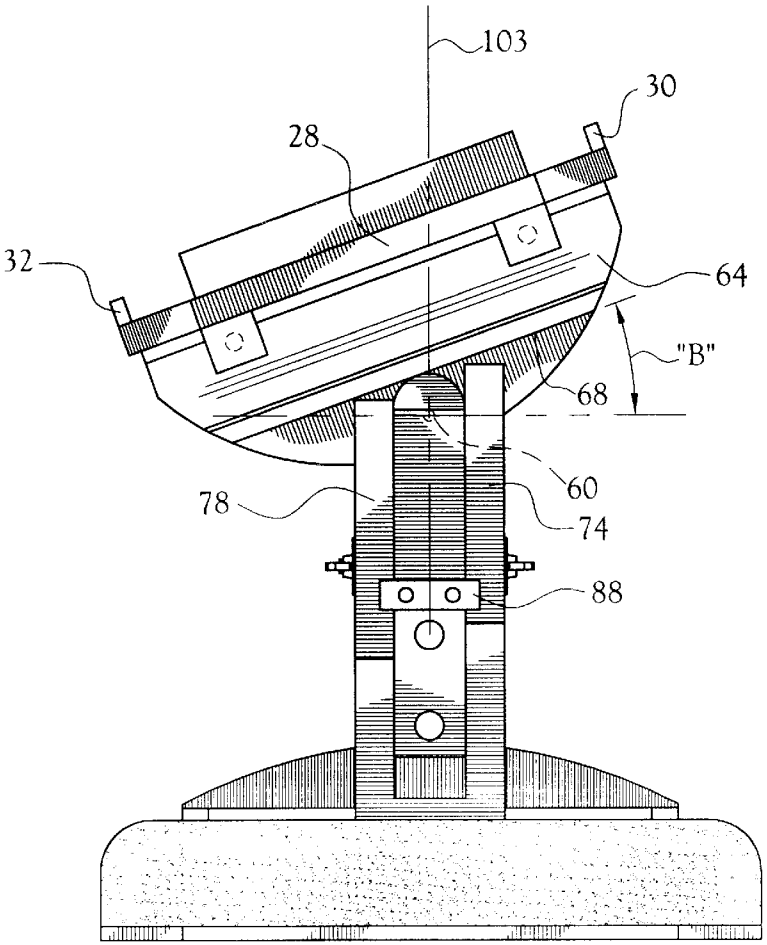
FIG. 6*b* is an end view of the work station depicted in FIG. 6*a* and depicting the work platform rotated relative to the horizontal to a second limit position.

The work platform 20 is vertically adjustable relative to the base 12, and is rotatable about the axis 60 to allow the user to position upper surface 22 of the work platform at a plurality of heights and at a plurality of rotational positions thereof between a first limit position (see FIGS. 1 and 6*a*) and a second limit position (see FIGS. 2 and 6*b*).

Figure 3:
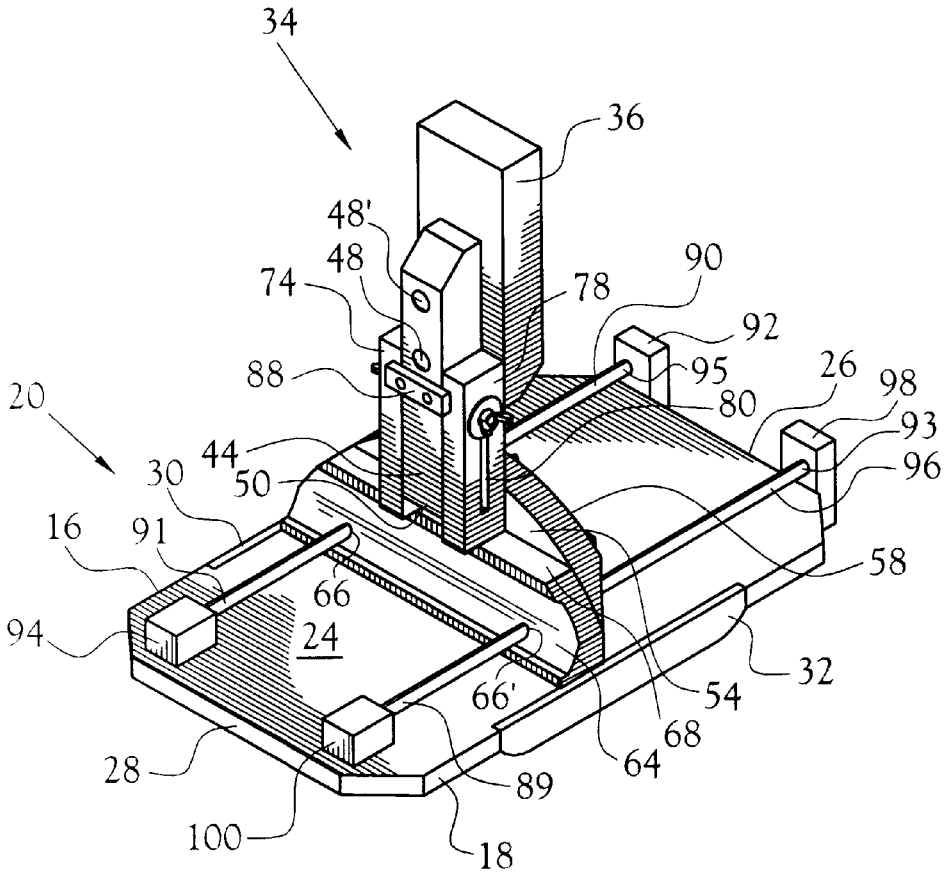
FIG. 3 is a perspective view of the underside of the work platform of the work station depicted in FIG. 1.
Figure 4:
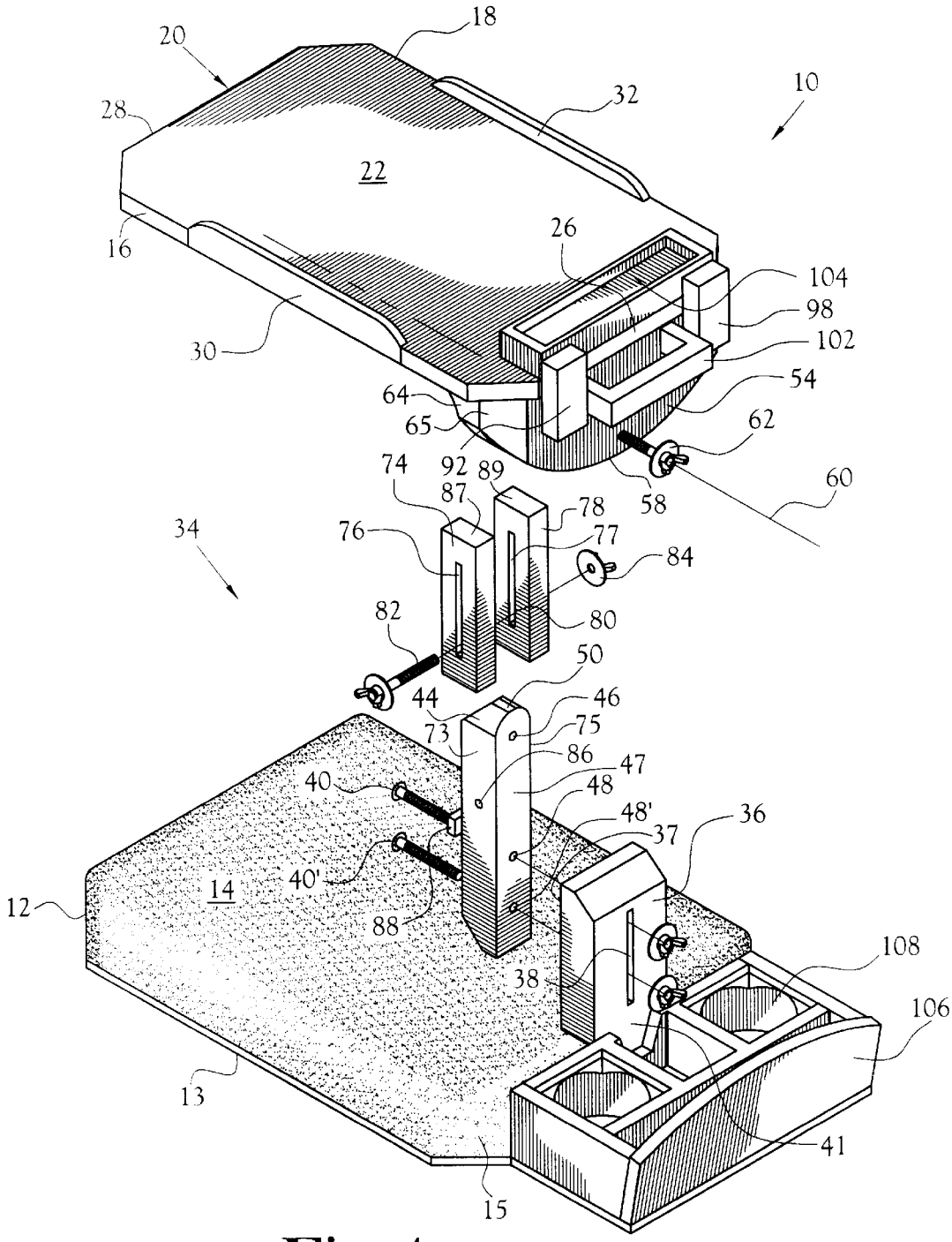
FIG. 4 is a perspective, partly exploded, view of the work station depicted in FIG. 1.
Figure 5:
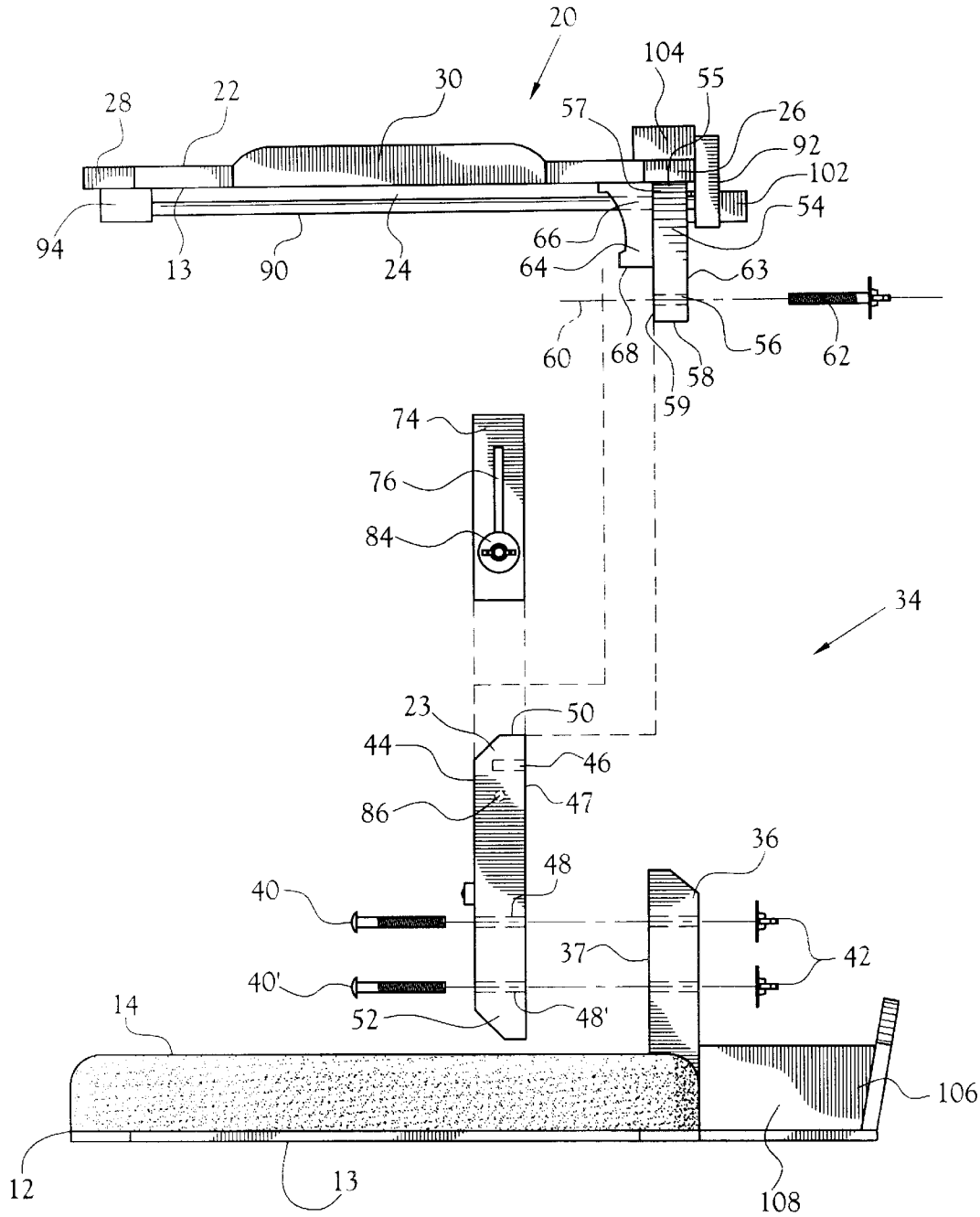
FIG. 5 is a side view of the work station depicted in FIG. 4.

Referring to FIGS. 3–5, one embodiment of the means for adjusting the vertical spacing of the work platform 20 relative to the base 12 includes a support assembly 34. The depicted support assembly includes a first upright 36 having an elongated, vertically oriented, midline slot 38 extending through the thickness of first upright 36 (see FIG. 4), through which bolt connectors 40, 40' may be inserted. This first upright is anchored at its bottom end 41 to one end 15 of the base 12 and projects upwardly from, and perpendicular to, the base. A second upright 44 is vertically aligned with the first upright 36, and includes a flat surface 47 (see FIG. 4) facing against an inwardly facing surface 37 (see FIG. 5) of the first upright 36, so that the second upright 44 is disposed in sliding engagement with the first upright. The second upright is provided with throughbores 48, 48' through its thickness. Bolt connectors 40, 40' extend through the throughbores and through the slot 38 to receive wing nuts 42 and 42' thereon for adjusting the frictional engagement, hence the vertical placement, of the second upright with respect to the first upright 48, 48'. The height of the upper end 50 of second upright 44 in relation to first upright 36 is therefore adjustable by loosening respective wing nuts 42, 42' connected to bolt connectors 40, 40' and adjusting the connecting pressure applied by wing nuts 42, 42' and bolt connectors 40, 40' against the respective facing surfaces 37, 47 of the first upright 36 and second upright 44 (see FIG. 4 and FIG. 5).

Referring to FIGS. 4 and 5, there is provided between the upper end 50 of the second upright and the bottom surface 24 of the work platform, means for interconnecting the upper end 50 to the work platform, including a first slide block 54 that is fixedly mounted along the flat surface 55 of its base 57 to the bottom (underside) surface 24 of the work platform and projects perpendicularly downward from the work platform such that the lower margin 59 of the face 61 of the slide block lies alongside the surface 47 of the top end 50 of the second upright 44. A throughbore 56 through the thickness of the lower margin of the slide block is disposed in register with a blind bore 46 which opens outwardly of the surface 47 of the second upright 44. A bolt 62 extends through the throughbore 56 and is threadably received in the blind bore 46. This bolt serves to define an axis of rotation 60 of the slide block relative to the second upright hence an axis of rotation of the plane of the work platform. Adjustment of the bolt 62 thus effects the degree of frictional engagement between the slide block and the upper end of the second upright 44, hence anchoring of the rotational attitude of the work platform relative to the horizontal 71 (see FIG. 6*a* and 6*b*). In the depicted embodiment, first slide block 54 is provided with an arcuate lower edge 58 to eliminate any sharp corners on the lower side edge of the slide block that might interfere with the desired rotational attitude of the work platform. The depicted axis 60 preferably is disposed generally horizontal but it will be recognized that this axis may be oriented at an angle from the horizontal by altering the orientation of the second and first uprights 36,44 to be other than generally vertical.

Figure 6A:
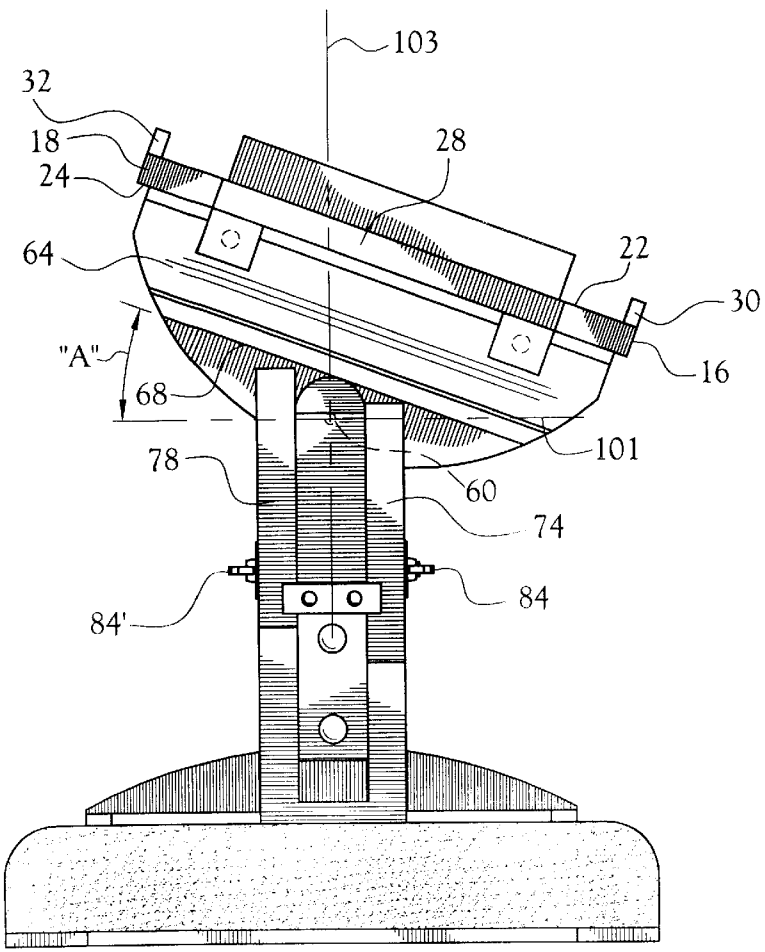
FIG. 6*a* is an end view of the work station depicted in FIG. 1 and depicting the work platform rotated relative to the horizontal to a first limit position.

Referring to FIGS. 4, 6*a* and 6*b*, the angle of rotation (arrows "A" and "B") of the position of the work platform 20 about the axis 60 is limited between first and second limits by a pair of adjustable stops 74, 78 positioned alongside opposed surfaces 73 and 75 of the upper end 50 of second upright 44.

As depicted in FIG. 3, the slide block 54 extends substantially across the width of the work platform 20 and is oriented generally perpendicular to the length of the work platform. Also as depicted in FIGS. 3 and 4, a second block 64 is mounted alongside the upper margin 65 of, and is substantially coextensive in width with, the slide block 54, thereby effectively increasing the thickness of the upper margin 65 of the slide block. This structure of the combined slide block 54 and the second block 64 provides a central support for first and second rods 90 and 96, each of which extends through first and second throughbores 66,66' that extend through the thickness of the combined slide block and second block, and is slidable within these throughbores. Each of the rods 90,96 includes first and second opposite ends 89,91 and 93,95 respectively. The first ends of the rods are fixedly mounted along the under surface 24 of the work platform at a location distal of the upright support for the work platform as by means of mounting blocks 100 and 94. The second ends 93,95 of the rods are similarly fixedly mounted, as by means of mounting blocks 98 and 92 to the end 26 of the work platform and at a location on the opposite side of the slide block from the location of the mounting of the first ends of the rods. Thus, the work platform is maintained stable relative to its upright support by the rectangular disposition of the mounting blocks 100,94,98, and 92, and the spaced apart locations of the throughbores 66 and 66' through which the rods are slidable mounted. Importantly, this mounting arrangement of the work platform further provides for infinite lateral translation of the work platform relative to its support assembly and between the limits established by the locations of the mounting blocks 100,94 relative to the mounting blocks 98,92. This translation of the work platform provides for ready movement of the work platform laterally away from a user to permit the user to move easily away from the work station without otherwise moving the work station. Also importantly, this translation is available irrespective of the disposition of the work surface relative to the horizontal, as depicted in FIGS. 6*a* and 6*b* and FIG. 3.

Referring specifically to FIGS. 4,5,6*a* and 6*b*, it will be observed that the rotational attitude of the planar work platform relative to its vertical upright support is readily selectable by loosening the bolt 62 which serves to mount the slide block 54 to the upper end 50 of the upright support 44, rotating the slide block about the axis 60 defined by the bolt 60 to select a desired position of the planar work platform relative to the horizontal 101 and then tightening the bolt to secure the work platform in its selected rotational position. Notably, the rotation of the slide block about the axis 60 is bidirectional thereby permitting the work platform to be tilted at any position through an arc having its locus at the axis 60 defined by the bolt 62.

In the present invention, the inventor provides for limits upon the extent of rotation of the work platform about the axis 60 by means of the first and second stops 74 and 78. Each of these stops comprises an elongated substantially rigid member, each having a through slot 76,77 extending through the thickness thereof approximate the central midline of the member, but terminated short of either of the opposite ends of the member. The first stop 74 is disposed alongside and in vertical alignment with the surface 73 of one side of the second upright 44. The second stop 78 is disposed alongside and in vertical alignment with the surface 75 of the upright support 44. A throughbore 86 is provided through the thickness of the second upright and which extends between the surfaces 73 and 75 of second upright 44. When the stops are aligned with the upright 44, their respective slots 76 and 77 are in register with this throughbore 86. Bolt means 82 extends fully through the registered slots and the throughbore 86, and receives on its end a wing nut 84. By this means, each of the stops is adjustable with respect to its vertical height along its respective side of the second upright 44, within the limits of its respective central slot 76 or 77. In the depicted embodiment, this adjustment of each stop may be effected independently of the other of the stops by loosening the single wing nut 84 and thereafter tightening this wing nut once the vertical location of each stop is selected. It will be obvious that each stop could be provided with its own adjustment bolt if desired. In any event, the limit of vertical positioning of the upper end 87,89, respectively, of each of the stops is selected to permit such upper end of each stop to project vertically above the upper end 50 of the second upright 44 in position to be engaged by the underside flat edge 68 of the second block 64 that is secured to the slide block. By this means, the limit of rotation of the work platform about the axis of the bolt may be limited by the vertical position of the stops. It will be recognized that since each stop may assume a different vertical position than the other of the stops, the rotation of the work platform may be limited to the same or to different degrees of rotation on either side of the horizontal. Of course, through selection of both the stops, the work platform may be positioned in the horizontal as desired.

Irrespective of whether the support assembly of the work station is located to the right or left of the user, the user may equally access the work platform. For example, a user may position the work station on either side of a bed and by adjusting the horizontal attitude of the work platform, they can gain access to the work platform.

As depicted in FIGS. 4 and 6*a*,6*b*, the upper end 50 of the second upright 44 is rounded to maximize the extent of rotation of the work platform in either direction from the horizontal 101. In a preferred embodiment, the work platform is rotationally adjustable at any position along an arc of about 140 degrees, e.g. tilted clockwise to a maximum angle of about 70 degrees from the horizontal 101 as viewed in FIG. 6*a* and indicated by the arrow "A" or tilted counterclockwise to a maximum angle of about 70 degrees from the horizontal 101 as viewed in FIG. 6*b* and indicated by the arrow "B". Through the means of the depicted non-horizontal positioning of the work platform, the upper surface 22 of the work platform is equally accessible from either side of the work station.

All adjustments of the work platform 20 relative to the support assembly 34 are available to a user without repositioning of the base 12.

The adjustable work station 10 of the present invention is readily portable from one location to a second location as by means of a handle 102 affixed to the end 26 of the work platform. The contoured cushion provided on the surface 14 of the base may be positioned under the knees of a reclined or seated user. Further, the work station of the present invention may be positioned on a bed (user reclined or sitting up), table (for standup work), floor (user seated on floor), or other generally planar surface.

With specific reference to FIGS. 7–9, in accordance with one embodiment of the portable work station 10 of the present invention, there is provided a separable mounting platform 150 for removably receiving the work station and providing a back rest 152 for the user of the work station. In the depicted embodiment, the mounting platform 150 includes an elongated planar base 154 adapted to be supported on a floor, for example, and a generally planar back rest 152 extending upwardly from the inboard end 156 of the mounting platform. The inboard end of the platform is provided with first and second arm rests 158,160, respectively, one each of which is disposed on the opposite sides 162,164 adjacent the inboard end of the platform. In the depicted embodiment, each arm rest includes an upright 166 having one end 168 thereof pivotally anchored to the side 162 of the inboard end 156 of the mounting platform, an elongated connector bar 170 having first and second ends 172,174 and having its first end 172 pivotally connected as by a pin 176 to the upper end 178 of the upright 166. The opposite and distal end 174 of the connector bar 170 is provided with a plurality of throughbores 180 (typical) which extend through the thickness of the connector bar at spaced apart distances from the distal end 174 of the connector bar and proximate a first side edge 182 of the backrest 152. A blind bore (not depicted) is provided in the side edge 182 of the backrest in position to be placed in register with either one of the throughbores 180 in the connector bar 170. A pin 184 is provided for insertion through a throughbore of the connector bar and into the blind bore (not shown) in the side edge of the backrest, thereby providing for adjustment of the angular relationship between the platform and the backrest. Hinges 186 and 188 are provided for establishing hinged connection between the bottom edge 190 of the backrest with the inboard end 156 of the platform. As desired, each connector bar may be provided with a support member 192 on which a user may rest their arm. As desired, either one or all of the platform, backrest and/or arm support members may be cushioned, at least in part, for the comfort of the user.

Adjacent the distal end 194 of the platform, there is provided first and second rows 196,198 of spaced apart blind bores 200 (typical), each row extending substantially parallel to the length dimension of the elongated mounting platform 150. One row 196 is disposed alongside the side margin 202 of the distal end of the platform and the other row 198 is disposed alongside the opposite side margin 204 of the distal end of the platform.

As depicted in FIGS. 8 and 9, the present inventor provides a carrier 206 having a flat planar bottom member 208 and first and second upstanding flanges 210,212 respectively, that extend along each of first and second opposite sides 214,216 of the bottom member. Each flange projects upwardly from the bottom member by a distance less than the vertical height of the base 12 of the work station 10 as best seen in FIG. 7. The spatial distance between the inside walls 218 and 220 of the flanges is substantially equal to, but not lesser than, the width dimension of the base so that the base 12 may be substantially snugly disposed between the flanges.

The carrier 206 is further provided with at least one, and preferably a plurality of pegs 222 (typical) which projects vertically downwardly from the underside 224 of the bottom member 208 of the carrier 206 and in position to be inserted into a respective one(s) of the blind bores 200 in the distal end of the mounting platform, thereby releasably fixing the position of the carrier 206 along the length dimension of the platform and relative to the backrest 152. By this means, the user may select that position of the carrier, hence the position of the work station, relative to the back rest, as desired for the most comfortable position for the user of the work station.

In a preferred embodiment, the major components of the present work station are formed of wood, but other materials of construction may be employed.

Whereas the present invention has been described in specific details with respect to the illustrated embodiments, it will be recognized that alternative embodiments of the disclosed apparatus may be employed without departing from the scope of the present invention as set forth in the appended claims. For example, it will be recognized by one skilled in the art that the slide block and the second block may be unitary, the translation of the work platform may be provided for by employing rack and pinion type gearing or other suitable apparatus, and that various embodiments of the structure for vertically adjusting the vertical position of the work platform relative to the base may be employed, so long as such alternatives neither delete from nor materially reduce the desired effectiveness of the structure which provides the desired multiplicity of positional attitudes of the work platform relative to its base.

What is claimed:

1. A portable adjustable work station comprising:

a substantially planar base;

a substantially planar work platform disposed substantially vertically above said base said platform having top and bottom surfaces;

a support assembly extending between said base and proximate said work platform and supporting said work platform relative to said base, said support assembly including means for vertically adjusting the vertical spacing of said work platform relative to said base, said support assembly having an upper end;

means interposed between said upper end of said support assembly and said work platform for interconnecting said upper end of said support assembly to said work platform and rotational positioning of said work platform about an axis extending laterally from said support assembly, whereby the plane of said work platform is rotationally adjustable relative to said support assembly between first and second limits; said means including guide block means secured to said bottom surface of said platform and rotatably associated with said upper end of said support assembly and means associated with said guide block and said bottom surface of said platform for selectively translating said work platform laterally relative to said support assembly within its plane at any of the rotational positions of said work platform without disassembly of said support assembly and said guide block.

2. The portable adjustable work station of claim 1 wherein said support member includes a first upright having a first end secured to said base, said first upright including an elongated, vertically oriented, midline slot extending through the thickness thereof, a second upright having an upper end and a first surface including means defining a throughbore extending through the thickness thereof, and adjustable connector means extending through said throughbore and said slot when said slot and said throughbore are in register whereby the vertical position of said second upright relative to said first upright is selectable.

3. The portable adjustable work station of claim 2 wherein said work platform includes an underside, and said means interposed between said upper end of said second upright and said work platform comprises a planar slide block having a generally flat planar upper side disposed contiguous to and secured to said underside of said work platform and an opposite arcuate side said slide block including a marginal region of said arcuate side thereof disposed continuous to and alongside said first surface of said second upright, and releasable means securing said marginal region of said slide block to said first surface of said second upright and defining an axis about which said slide block, hence the rotational position of said work platform, may be rotationally selected independently of the vertical position of said second upright support to said first upright support.

4. The portable adjustable work station of claim 3 and including at least one stop disposed alongside said second upright, said stop including an upper end adapted to engage said slide block or an appurtenance thereto whereby engagement of said slide block or an appurtenance thereto limits the rotational movement of said work platform in at least one direction about said axis.

5. The portable adjustable work station of claim 4 and including a further stop disposed alongside said second upright and on that side of said second upright opposite said stop, said second stop including an upper end adapted to engage said slide block or an appurtenance thereto whereby engagement of said slide block or an appurtenance thereto limits the rotational movement of said work platform in at least one direction about said axis.

6. The portable adjustable work station of claim 1 wherein said work platform includes first and second opposite sides defining the width of said work platform and first and second opposite ends defining the length of said work platform, and wherein said means for selectively translating said work platform laterally within its plane comprises first and second elongated members having respective first and second opposite ends, said elongated members being secured at their first ends to said first end of said work platform at respective spaced apart locations adjacent said first end of said work platform and at their second ends to said second end of said work platform at respective spaced apart locations adjacent said second end of said work station, said elongated members being oriented substantially parallel to one another.

7. The portable adjustable work platform of claim 6 wherein said elongated members comprise first and second rods.

8. The portable adjustable work platform of claim 7 wherein said work platform includes an underside, and including a planar slide block shaving a generally flat planar upper side disposed contiguous to and secured to said underside of said work platform, wherein each of said rods is disposed substantially perpendicular to said slide block and slideably extends through respective throughbores which extend through the thickness of said slide block.

9. The portable adjustable work platform of claim 1 and including a handle mounted on said work platform.

10. The portable adjustable work platform of claim 1 wherein said base includes an upper surface and including a cushion disposed on said upper surface suitable for the resting of a user's legs thereupon.

11. The portable adjustable work platform of claim 1 wherein said work platform is rotatable about said axis about an arc of about 140 degrees.

12. The portable adjustable work station of claim 11 wherein said work platform is rotatable about 70 degrees from the horizontal in either direction away from the horizontal.

* * * * *